US006378964B2

(12) United States Patent
Robbins et al.

(10) Patent No.: US 6,378,964 B2
(45) Date of Patent: Apr. 30, 2002

(54) ROTARY STEPPED STORAGE AND DISPLAY DEVICE AND METHOD

(75) Inventors: Rodney W. Robbins, Florence; Carter McGuyer, Tuscumbia, both of AL (US)

(73) Assignee: Robbins Industries, Inc., Florence, AL (US)

( * ) Notice: Subject to any disclaimer, the term of this patent is extended or adjusted under 35 U.S.C. 154(b) by 0 days.

(21) Appl. No.: 09/782,661

(22) Filed: Feb. 13, 2001

Related U.S. Application Data

(62) Division of application No. 09/457,215, filed on Dec. 9, 1999, now Pat. No. 6,263,808.

(51) Int. Cl.[7] ..... A47B 77/16; A47F 3/10

(52) U.S. Cl. ..... 312/305; 312/135; 312/238; 211/129.1

(58) Field of Search ..... 312/305, 238, 312/197, 202, 125, 135, 351.2, 114; 108/94; 211/129.1

(56) References Cited

U.S. PATENT DOCUMENTS

| | | | | |
|---|---|---|---|---|
| 253,877 A | | 2/1882 | Messler | |
| 534,423 A | | 2/1895 | Burhen | |
| 786,013 A | * | 3/1905 | Domann | 312/107 |
| 799,104 A | | 9/1905 | Sprague | |
| 1,226,134 A | | 5/1917 | Srader | 108/94 |
| 2,044,518 A | * | 6/1936 | Thorstensen | 312/135 |
| 2,327,631 A | | 8/1943 | Fibus | 211/74 |
| 2,380,005 A | * | 7/1945 | Wilson | 312/305 |
| D149,046 S | | 3/1948 | Blumenthal et al. | |
| 2,759,611 A | | 8/1956 | Davis | |
| 2,777,585 A | | 1/1957 | Jorgensen | 108/94 |
| 3,415,208 A | | 12/1968 | Thoresen et al. | |
| 4,025,137 A | | 5/1977 | Wyler | 312/114 |
| D372,374 S | | 8/1996 | Weterrings | D6/432 |
| 5,894,944 A | | 4/1999 | Swift | 211/78 |
| 5,895,021 A | | 4/1999 | Rosenband et al. | 108/20 X |

FOREIGN PATENT DOCUMENTS

| | | | |
|---|---|---|---|
| CH | 373845 | 4/1951 | 211/129.1 |
| DE | 188857 | 9/1907 | 211/129.1 |
| FR | 991557 | * 10/1951 | 312/305 |

* cited by examiner

*Primary Examiner*—James O. Hansen
(74) *Attorney, Agent, or Firm*—Kramer Levin Naftalis & Frankel LLP; Gregor N. Neff

(57) ABSTRACT

A rotary stepped storage and display unit is placed on shelves in cabinets and other locations above eye level to store and display items such as spice jars etc. on a stepped surface so that items can be seen easily from below. Preferably, the device comprises a circular stepped pyramid on a rotary base. The device is provided in separate sections which are small enough to pass through the access opening to corner cupboards in kitchens or similar places where the access openings are considerably smaller than the inside dimensions of the cupboard. Easy-to-use snap fasteners are integral with the sections and are used to fasten the sections together inside the cabinet to form a structure which is too large to pass through the access opening but utilizes the space efficiently in the cabinet. The device either can rotate on its own rotary base, or can be mounted on one or more of the upper shelves of a series of rotary shelves mounted to rotate on a vertical axle in a corner or similar cupboard.

15 Claims, 6 Drawing Sheets

10
12
14
18
20
21
22
23
24
25
26
27
28
30
32
38
40
42
44
46
48
50
52
66
69
70
72
73
74
75
76
78

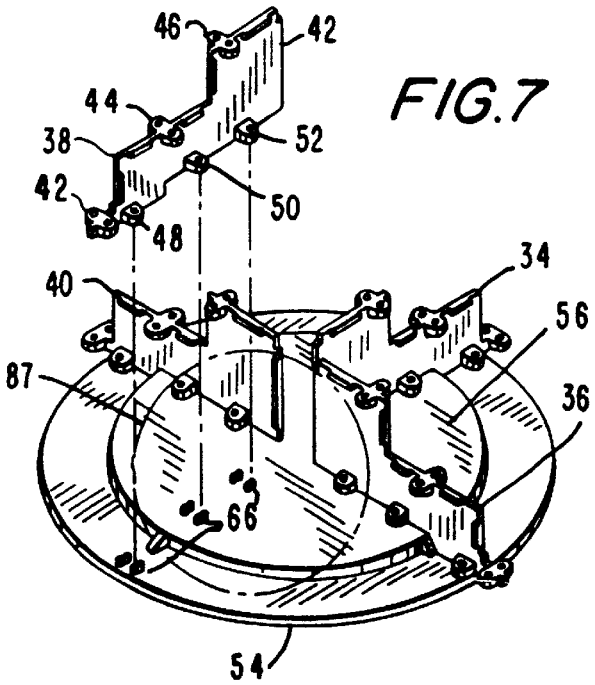
FIG.7
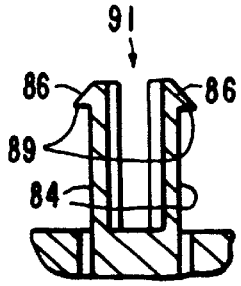
FIG. 8A
FIG.8
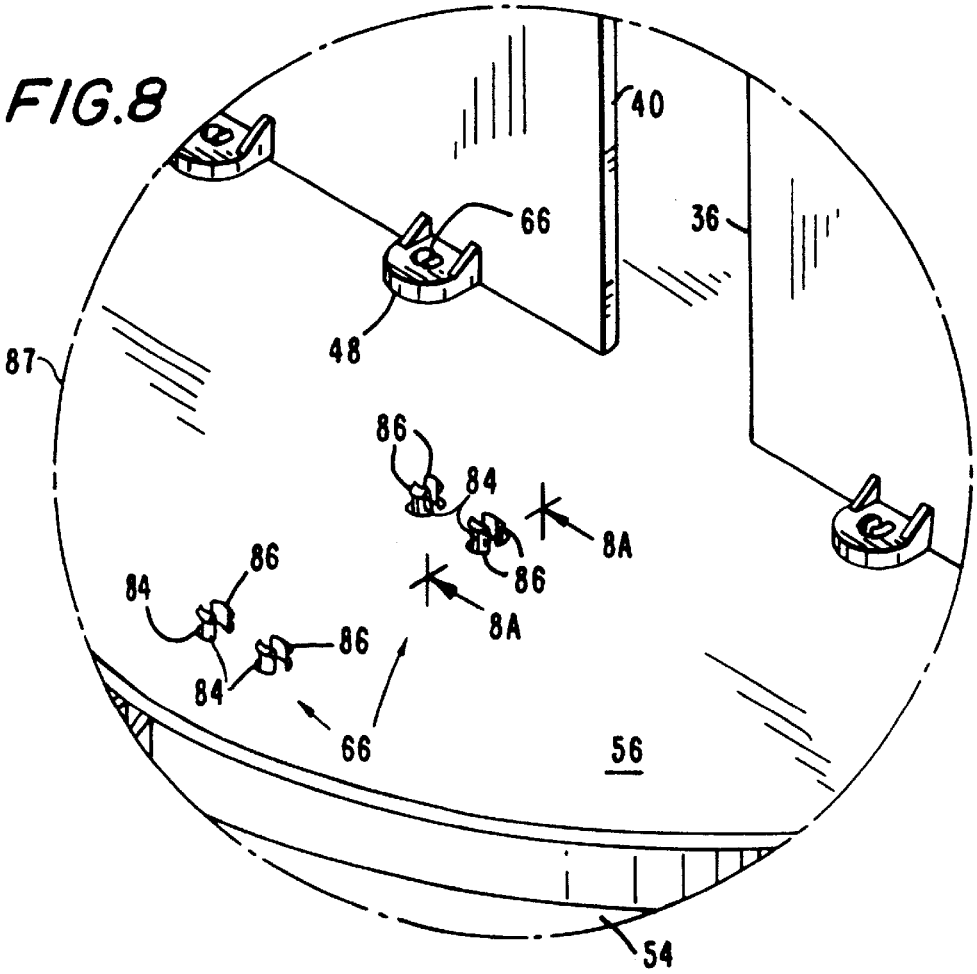

ROTARY STEPPED STORAGE AND DISPLAY DEVICE AND METHOD

This application is a divisional application of prior application Ser. No. 09/457,215, filed Dec. 9, 1999, now U.S. Pat. No. 6,263,808.

This invention relates to storage and display devices for use in cabinets, particularly in kitchen cabinets above eye level.

In kitchen cabinets and other similar storage areas, it is difficult to see items which are stored on shelves above eye level. To alleviate this problem, stair-step-shaped rectangular storage and display units have been provided, such as those shown in U.S. Pat. Nos. 4,025,137 and D 372,374. Such devices work well for ordinary cabinets, but corner cabinets cause special problems which have been recognized by the inventors herein.

In corner cabinets, typically the access opening is considerably smaller than the space inside the cabinet. Thus, the when one of the prior art storage and display units is used in such cabinets, the device only occupies a small fraction of the available space in the cabinet so that all of the objects mounted on the device for storage are visible to the observer from below. Thus, there is a substantial amount of wasted space in such arrangements.

In some corner cabinets, rotary shelf structures are installed when the cabinets are being built. Such structures include a vertical axle anchored at the top and the bottom in the corner cabinet, with several shelves rotatably mounted on the axle and spaced vertically from one another. Although such rotary shelves make it possible to see many more objects being stored than with fixed shelves, the shelves are relatively expensive and often must be installed during the building of the cabinets rather than later. Additionally, it is very difficult to see objects on the top shelf.

Accordingly, it is an object of the present invention to provide a solution for the foregoing problems. In particular, it is the object of the invention to provide a relatively inexpensive stepped storage and display device which can be used to display a relatively large number of objects in a manner such that they can be seen easily.

It is a further object of the invention to provide such a rotary storage and display device in a cabinet with restricted access space such as in a corner cabinet and a method of installing the device simply and easily.

It is a further object of the invention to provide such a device which is easy to use and assemble and relatively inexpensive to manufacture.

The foregoing objectives are met, in accordance with the present invention, by the provision of a rotary stepped pyramid-shaped shelf storage and display device.

In particular, the invention provides such a device which is sold to the consumer in separate sections which are small enough to pass through restricted access openings in corner cabinets and the like, and which easily can be assembled when inside the cabinet to produce a stepped storage device which is too large to pass through the access opening when fully assembled. Because it is a rotary device, items which are stored on it can be seen by simply rotating the device to bring the items into view through the access opening to the cabinet.

Preferably, the parts of the storage and display device are formed so that when they are assembled, the device has a central hole large enough to allow the device to rotate about a vertical fixed axle in a corner cabinet which already is equipped with a vertical axle and rotary shelves. Preferably, the storage and display device rests on one or more of the upper shelves of such an arrangement, thus making it possible to better see the objects on the upper shelves.

Preferably, the sections of the storage and display device are provided with snap-acting fasteners so as to allow the parts to be assembled together simply by pressing the parts of the fasteners on one section into the complementary parts of the fasteners on the other section to snap the sections together.

The foregoing and other objects and advantages of the invention will be set forth in or will be apparent from the following description and drawings.

IN THE DRAWINGS

FIG. 7 is a partially schematic view illustrating certain steps used in the assembly of the device shown in FIG. 1;

FIG. 8 is an enlarged perspective view of a portion of the structure shown in FIG. 7;

FIG. 8A is a further enlarged cross-sectional and broken away view of one of the fastener studs shown in FIG. 8;

GENERAL DESCRIPTION

Figures 1, 2:
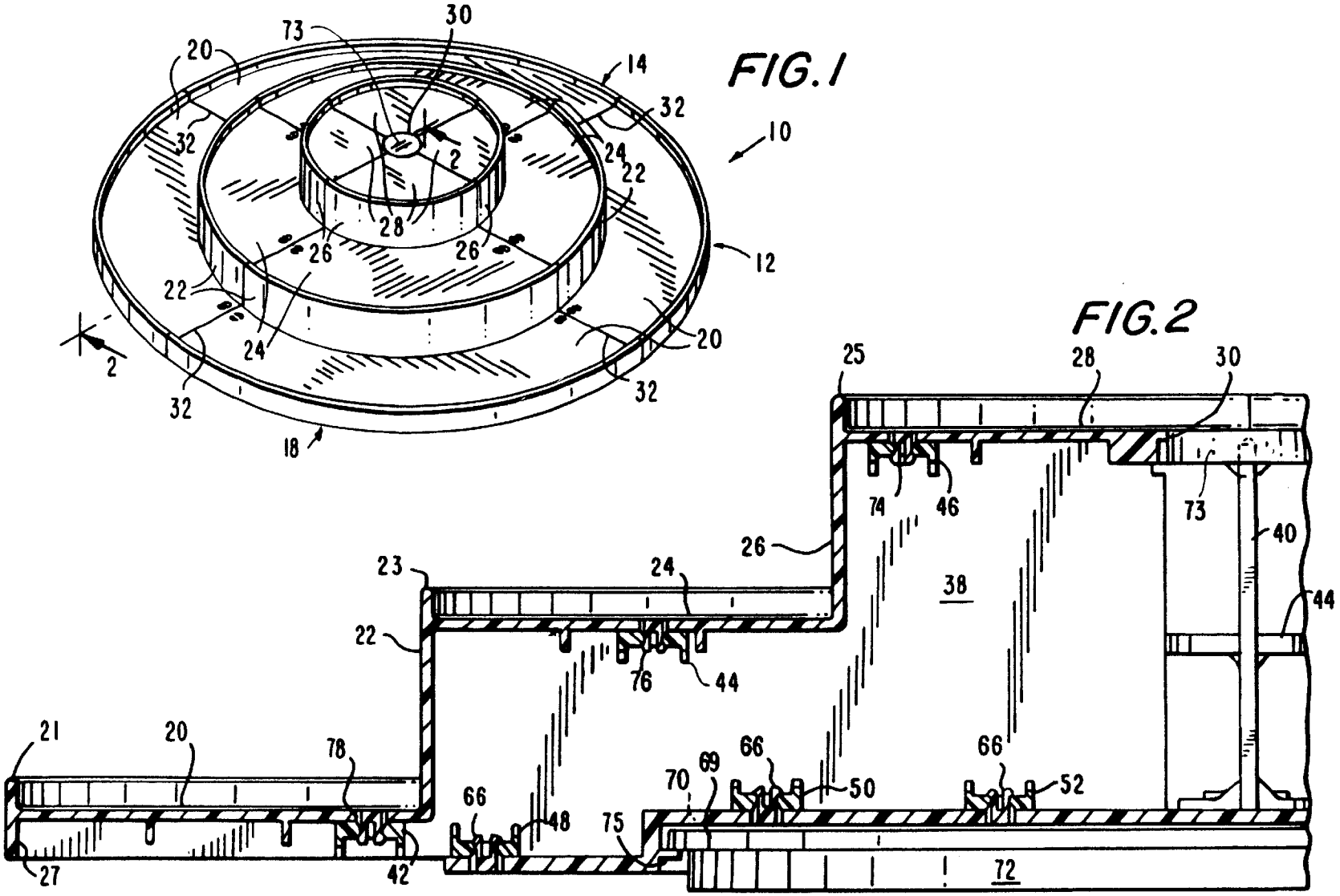
FIG. 1 is a perspective view of a rotary storage and display device constructed in accordance with the present invention.
FIG. 2 is a broken-away cross-sectional view taken along line 2—2 of FIG. 1.

FIG. 1 is a perspective view showing a rotary storage and display unit 10 constructed in accordance with the present invention. The unit 10 has the shape of a circular stepped pyramid. It has four cover sections 12, 14, 16 and 18, and a rotary base support 72 (FIG. 2) upon which it can be rotated. The assembled device 10 has three separate shelf areas 20, 24 and 28, with the shelf 24 being elevated above the shelf 20, and the shelf 28 being elevated above both shelves 20 and 24, with connecting vertical wall portions 22 and 26. Thus, items stored on shelves 28 and 24 can be seen better by someone standing below the shelf on which the unit is used.

Figure 4:
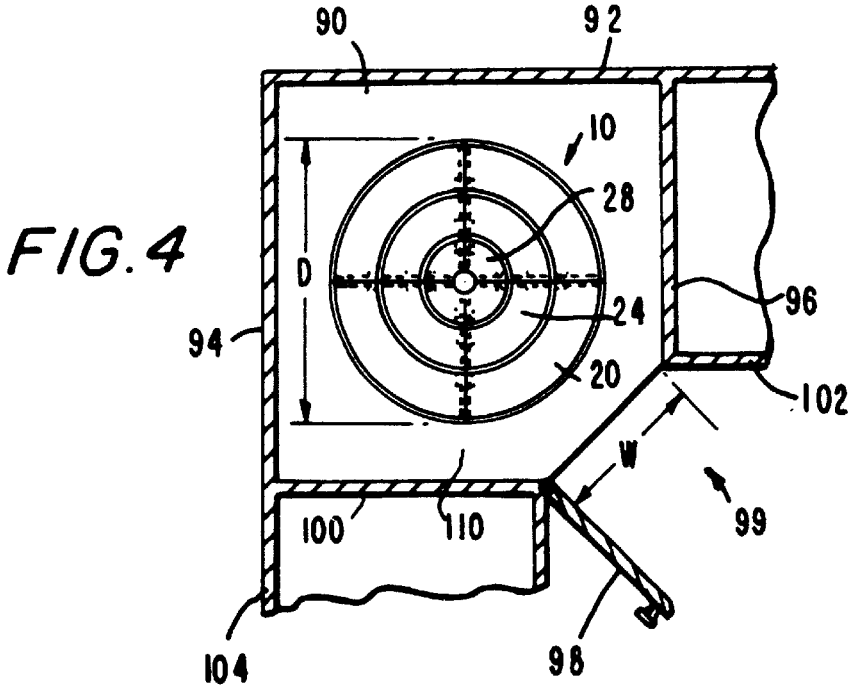
FIG. 4 is a top plan, partially cross-sectional view of the top compartment of a corner cabinet in which the device of FIG. 1 has been installed.

FIG. 4 is a cross-sectional top plan view of the top shelf area 90 of a corner cabinet in a kitchen with the storage and display unit 10 installed. The cabinet has side walls 92, 94, 96 and 100, and a hinged front door 98, as well as a bottom shelf 110.

In accordance with the present invention, the diameter D of the assembled unit 10 is substantially larger than the width W of the access opening 99 of the corner cabinet. The height of the top shelf area 90 also is insufficient to allow an assembled unit 10 to pass through the access opening to install it in the cabinet. However, in accordance with the present invention, the unit 10 is constructed so that it can be easily assembled by inserting the parts of the unit into the cabinet and assembling them there.

Figure 5:
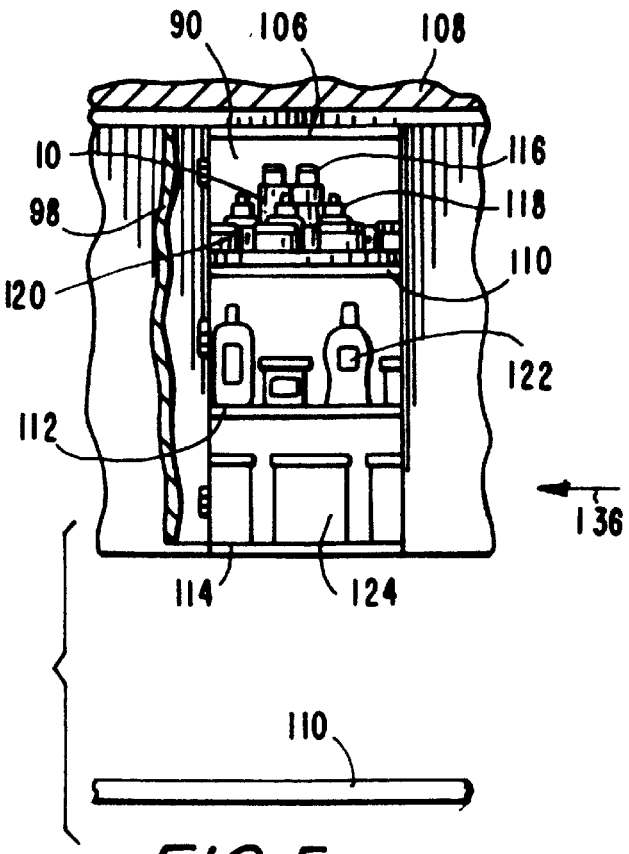
FIG. 5 is a front elevation view of a cabinet like that shown in FIG. 4 with the device of FIG. 1 installed and having objects stored on it.

FIG. 5 is a front elevation view taken in the direction of the arrow 99 in FIG. 4. As it can be seen, objects 120 are stored on the bottom shelf 20 of the unit 10, other objects 118 are stored on the second shelf 24, and further objects 116 are stored on the top shelf 28. Even though the objects stored on shelves 24 and 28 are small and ordinarily could not be seen from the eye level of the average sized person (illustrated as dashed line 136), they are visible due to the elevation provided by the device 10.

As it can be seen in FIG. 5, the corner cabinet also has a top wall 106, a bottom wall 114 and another shelf 112. Items 122 are on the shelf 112 and items 124 are on the bottom shelf.

Figure 6:
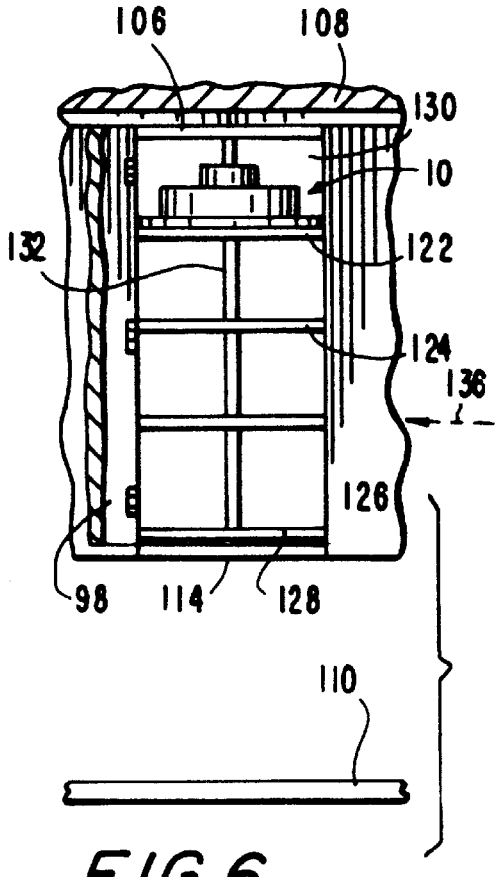
FIG. 6 is a view like that of FIG. 5 of a rotary shelf unit with a rotary stepped storage device mounted at the top.

FIG. 6 shows an alternative corner cabinet construction having some of the same structural elements as shown in FIGS. 4 and 5, with the use of the same reference numerals for such elements.

Secured to the top wall and bottom wall of the corner cabinet is a vertical axle 132. Circular shelves 122, 124, 126 and 128 are rotatably mounted on the axle 132. The shelves provide access to some of the items stored on the shelves by rotating the shelves to bring them into view. However, the space 130 above the upper shelf 122 and other high shelves often is either little utilized or poorly utilized due to the fact that objects cannot easily be seen on those shelves.

In accordance with the present invention, the storage and display unit 10 has a central hole 30, when assembled, which embraces the axle 132. Also, the unit 10 rests on the top shelf 120 so as to rotate about the axle 132.

The storage and display unit 10 can be used in a variety of different types of corner cabinets, as well as ordinary cabinets, other than the ones shown in FIGS. 4 through 6. Also, the unit 10 can be used on other shelves in addition to the top shelf, if desired.

STRUCTURAL FEATURES

Referring again to FIGS. 1 through 3, and particularly FIG. 3, the storage and display unit consists of a cover made of four sections 12, 14, 16, and 18, each covering one-quarter of a full circle. Also provided are four vertical rib panels 34, 36, 38, and 40. Each of these panels has snap-fastener stud receptacles 38, 42, 44, 46, 48, 50 and 52, each consisting of a tab with a pair of holes.

Also provided is a base member 54 with a raised central portion 56. Also provided are four radial arrays of pairs 66 of fastener studs. The stud arrays are located along four radial lines 90° apart from one another.

Figure 3:
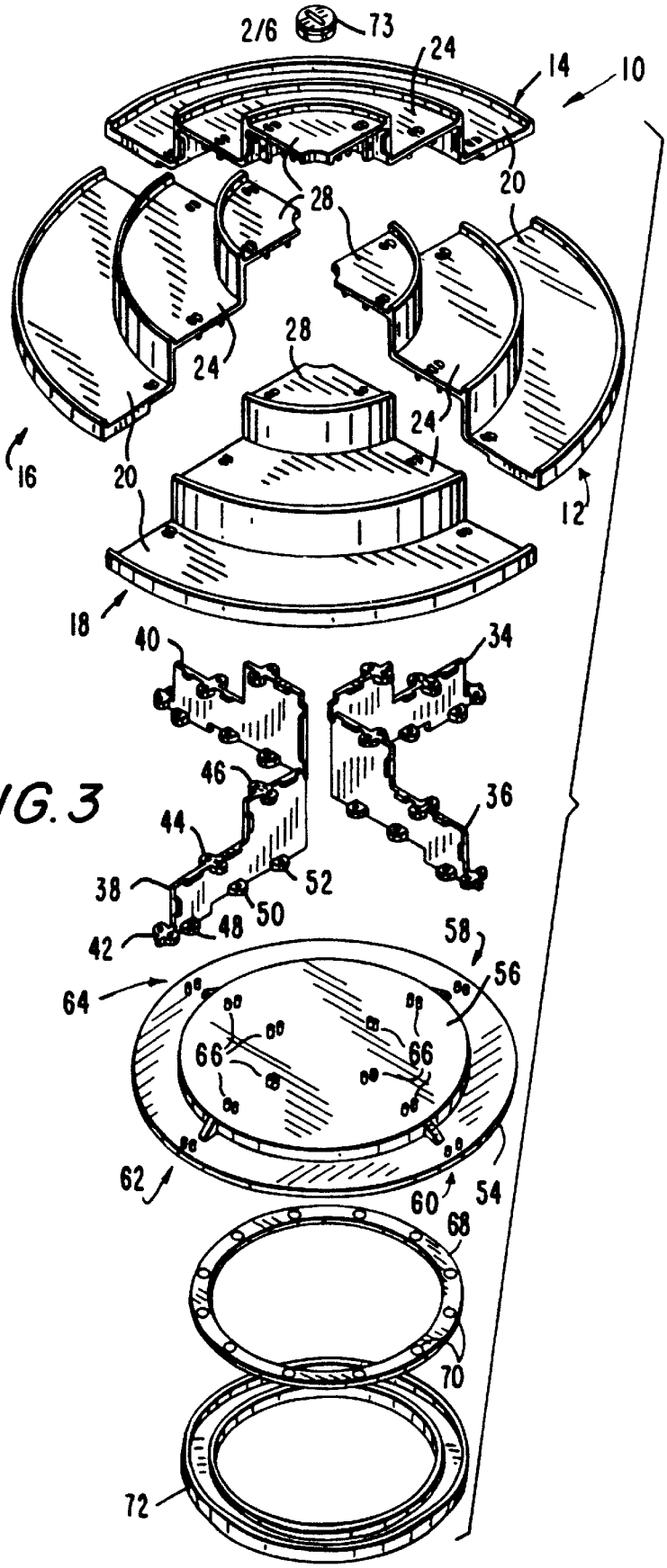
FIG. 3 is an exploded view of the device shown in FIG. 1.

Also shown in FIG. 3 is a ball bearing retainer 68 with ball bearings 70 rotatably secured therein, with a bottom ring 72 into which the retainer fits. As is shown in FIG. 2, the ring 72 is releasably secured into the bottom cavity of the unit by means of three resilient tabs 75 which are flexed so as to fit underneath the upper flange 69 of the bottom ring 72 to hold it in place.

Referring now to FIGS. 7, 8 and 8A, the unit 10 is assembled by pressing the receptacles 42, 48, 50, and 52 of each of the vertical rib panels down onto the studs 66 to fasten the four vertical rib panels onto the base 54.

FIG. 8 is an enlarged view taken in the circled area 87 of FIG. 7 illustrating some of the stud pairs 66, and edges of two of the rib panels 40 and 36 showing receptacles secured onto the studs 66, and showing the studs in some detail.

FIG. 8A is a further enlarged cross-sectional view taken along line 8A—8A of FIG. 8 showing one of the studs. Each stud includes a pair of semi-cylindrical vertical members 84 each having a beveled upper surface 86 forming a catch 89. The distance between the edge of the catch 89 and the base is slightly greater than the thickness of the tab in which the receptacle opening is formed. The studs are embedded in the material of the base. Each member 84 is flexible. The hole in the receptacle which meets with each stud is just slightly larger than the diameter of the cylinder described by the stud members 84. Thus, when the receptacle is pressed down onto the stud, the two halves of each stud flex inwardly, as indicated by the arrows 91 in FIG. 8A, until the stud has passed all the way through the hole and the stud halves snap back to their original position with the catches 89 preventing the studs from being pulled back through the receptacle holes.

Thus, it is very easy to attach the vertical rib panels to the base as shown in FIG. 7 simply by aligning the holes in the receptacles 42, 48, 50 and 52 with the studs and pressing the panel down onto the studs until the fastener parts have snapped together.

As it is shown in FIG. 2, each of the cover sections, such as the cover section 18 shown in FIG. 2, has studs 74, 76 and 78 extending downwardly along each edge. To assemble the cover sections onto the vertical rib panels, the studs 74, 76 and 78 are aligned with one hole of each of the receptacles 42, 44 and 46 of two of the vertical rib panels, and the edges are pushed downwardly until the studs snap after passing through the openings of the receptacles. This is repeated for each of the other cover sections 12, 14 and 16 of the unit until the whole unit has been assembled.

Each of the cover sections has a semi-cylindrical recess in its inward end such that when the four units are attached together, a central hole 30 is formed.

If the unit 10 is to be used as a self-contained unit on a shelf, in a cabinet which does not have a vertical axle such as the one shown in FIG. 6, a cap 73 (FIG. 3) is pushed into the hole 30 to close it. However, if the unit is to be installed in a cabinet having a vertical axle, the cap is omitted and the cover sections are formed around the axle so that the axle passes through the hole 30 when the unit is assembled. The diameter of the hole 30 is larger than the diameter of the axle.

ROTARY SHELF EMBODIMENTS

Figures 9, 9A:
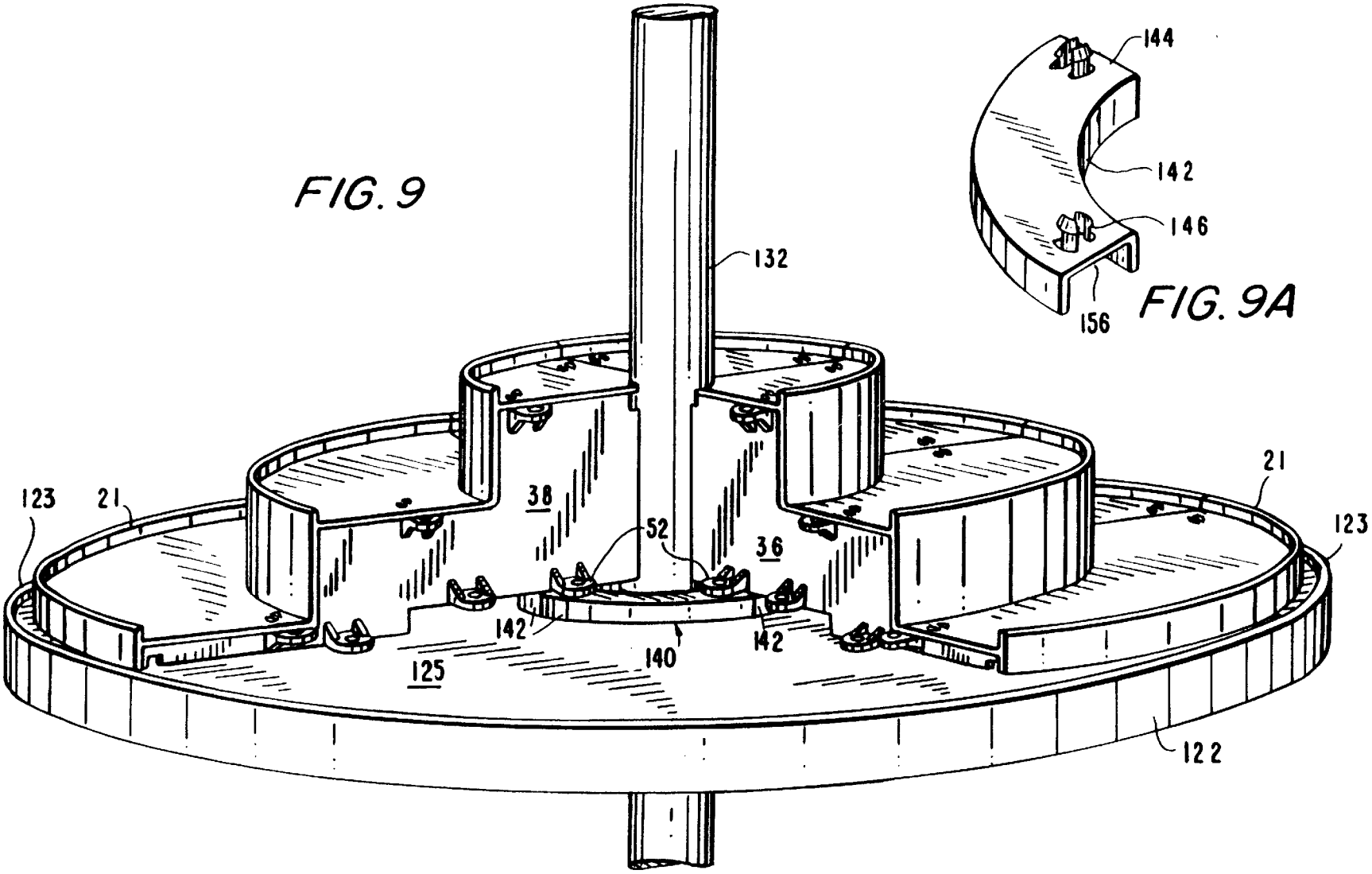
FIG. 9 is an enlarged perspective cross-sectional view of a portion of the embodiment of the invention when being used with a rotary shelf unit such as that shown in FIG. 6.
FIG. 9A is an enlarged perspective view of a component of the FIG. 9 structure.

A modification used when the unit 10 is installed together with a rotary shelf unit of the type shown in FIG. 6, is that, instead of the base 54, bearing 68, bearings 70, and bottom ring 72, there is provided a donut-shaped support 140 shown in FIG. 9. The support 140 is formed by four identical sections 142, one of which is shown in FIG. 9A. Each section 142 has a pair of studs 144 and 146 which snap-fit into holes in the tabs 52 on the vertical rib panels 36, 38, 40 and 42.

The height of the support 142 is sufficient to support the rib panels above the bottom 125 of the shelf 122.

The diameter of the storage and display device 10 at the outer rim 21 of the lowermost shelf is less than the diameter to the outer rim 123 of the rotary shelf 122.

Figures 9B, 9C:
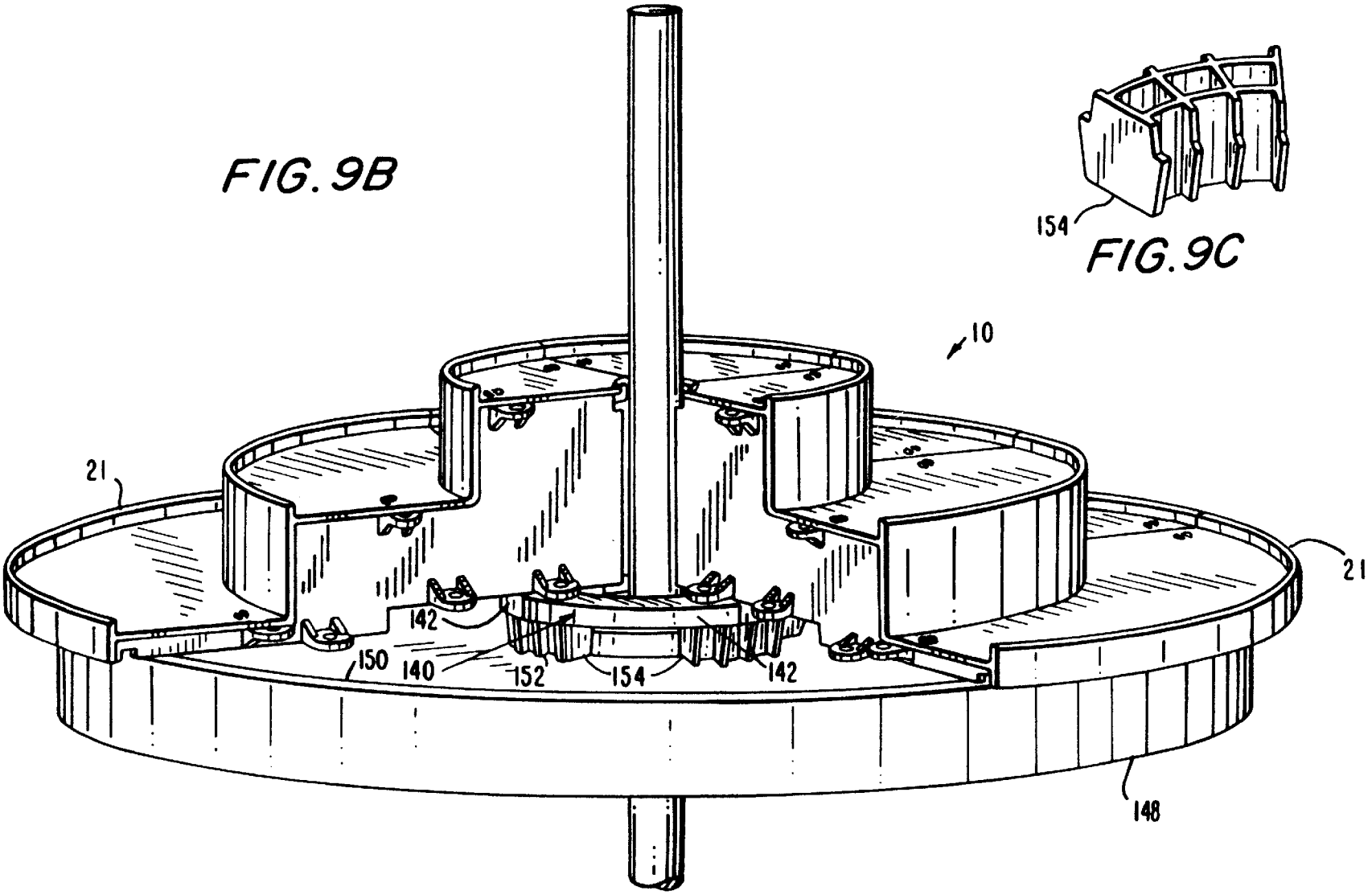
FIG. 9B is a view like FIG. 9 of another version of the FIG. 6 structure.
FIG. 9C is an enlarged view of a component of the FIG. 9B structure.

FIG. 9B shows an alternative embodiment in which the diameter of the rotary shelf 148 on which the device 10 rests is less than the diameter of the bottom of the rim 150 of the shelf 148, and thus is separated from the bottom 152 of the shelf 148 by a greater distance than in the embodiment of FIG. 9.

As it is shown in FIG. 9C, several arcuate molded plastic spacers 154 are provided. They fit into the channels 156 (FIG. 9A) in the undersides of the support 142 and thus, together with the supports 142, provide proper support for the vertical ribs and platforms of the device 10.

Preferably, the components of the unit 10, including the fastener parts, are molded out of a suitable thermoplastic material, such as high-impact polystyrene.

The rotary storage and display device of the present invention meets the foregoing objectives admirably. It easily can be assembled inside of a cabinet so as to enable the use of a larger device than can be admitted through the access opening to the cabinet. Furthermore, it can be used in conjunction with existing rotary shelf units installed integrally in the corner cabinets. Advantageously, the device of the present invention does not need to be built-in but can be added at a later time.

The limited view of the objects on the device caused by the restricted cabinet opening is alleviated by allowing the device to be rotated to bring all of the objects into view. The device has a substantially greater storage surface area than comparable rectangular non-rotary stepped storage and display devices would have in the same space.

The above description of the invention is intended to be illustrative and not limiting. Various changes or modifications in the embodiments described may occur to those skilled in the art. These can be made without departing from the spirit or scope of the invention.

What is claimed is:

1. A rotary stepped storage and display device in a cabinet, said device comprising, in combination, a cabinet having an interior space with an interior maximum dimension and a restricted access opening with a maximum dimension smaller than said interior maximum dimension, a plurality of segments of a stepped pyramid, said pyramid having a minimum dimension, said minimum dimension of said pyramid being greater than said maximum demension of said restricted access opening to said interior space of said cabinet, but smaller than the maximum interior dimension of said cabinet, each of said segments having a maximum dimension which is smaller than said maximum dimension of said access opening, and fasteners for fastening said segments together when said segments are inside said cabinet, whereby, said device can be assembled inside said cabinet.

2. A device as in claim 1 in which said fasteners comprise complementary snap-acting fastener parts secured to said segments to enable their assembly together by pressing the complementary parts together.

3. A device as in claim 1 in which said rotary stepped pyramid has a central opening and a vertical support member in said cabinet and through said opening.

4. A device a in claim 1 in which said stepped pyramid is circular and includes a rotary base dimensioned to pass through said restricted access opening, and said cabinet is a corner cabinet in the corner of a room.

5. A cabinet with a rotary stepped storage and display unit in said cabinet, said cabinet being located in a room, said cabinet having at least one portion which is above the average eye level of persons standing in said room, and an access opening to said one portion, said storage and display unit being located in said at least one portion and being viewable by people standing in said room, wherein said cabinet is a corner cabinet in a suite of built-in cabinets attached to walls of said room.

6. A cabinet as in claim 5 in which said stepped storage and display unit is too large to fit through said access opening, but the interior space in said at least one portion of said cabinet is large enough to accommodate said unit, said storage and display unit consisting of parts which have been assembled together in said cabinet.

7. A cabinet as in claim 5 in which said cabinet has a vertical axle with at least one shelf rotatably mounted on said axle, said stepped rotary storage and display unit having a central hole formed by said parts when attached together, and in which said axle passes through said hole and said unit rotates on said axle and rests on said shelf.

8. A cabinet as in claim 7 in which there are a plurality of shelves spaced vertically on said axle and rotatably mounted on said axle, said unit resting on the top one of said plurality of shelves at a height above average eye level in said room.

9. A method of installing a rotary stepped storage and display device in a cabinet, said method comprising the steps of:

(a) providing parts of a stepped pyramid and fasteners for assembling said parts together, (b) introducing said parts into a cabinet in which said device is to be installed, and (c) fastening said parts together while they are in said cabinet to form said stepped storage and display device.

10. A method as in claim 9 in which said cabinet contains a vertical axle, said stepped pyramid having a central hole formed when said parts are fastened together, said fastening step being performed while said parts are held in a position to embrace said axle when fastened.

11. A method as in claim 10 in which said cabinet contains at least one shelf mounted to rotate about said axle, said fastening step comprising mounting said stepped pyramid above said shelf to rest on said shelf.

12. A method as in claim 9 in which said parts include a base for rotatably supporting said stepped pyramid on a shelf, said fastening step including securing said stepped pyramid parts to said base.

13. A method as in claim 9 in which said cabinet has an access opening which is too small to admit a fully-assembled stepped pyramid, but has an interior large enough to receive and support said device, the dimensions of said parts being small enough to pass through said access opening.

14. A method as in claim 9 in which said fasteners are integral with said parts and are operable with hand pressure to snap together to assemble said parts without tools, and in which said fastening step comprises pressing said fasteners together.

15. A method as in claim 14 in which said fasteners comprise studs extending from one of the parts to be assembled, and tabs with holes extending from the other of said parts, each of said studs being enlarged at its outer end to a size greater than the size of said holes and being resiliently deformable when pressed into one of said holes to fit through said hole and, when through said hole, to expand to resist being pulled back through said hole.

* * * * *